US006126802A

United States Patent [19]

Utklev

[11] Patent Number: 6,126,802

[45] Date of Patent: Oct. 3, 2000

[54] METHOD AND DEVICE FOR REGULATING AND OPTIMIZING TRANSPORT OF HUMIDITY BY MEANS OF ELECTROOSMOSIS

[75] Inventor: Kjell A. Utklev, Kjellerod, Norway

[73] Assignee: Electro Pulse Technologies of America, Inc., Greenwich, Conn.

[21] Appl. No.: 08/983,377

[22] PCT Filed: Jul. 19, 1996

[86] PCT No.: PCT/NO96/00189

§ 371 Date: Mar. 8, 1999

§ 102(e) Date: Mar. 8, 1999

[87] PCT Pub. No.: WO97/04191

PCT Pub. Date: Feb. 6, 1997

[30] Foreign Application Priority Data

Jul. 19, 1995 [NO] Norway ..... 952874

[51] Int. Cl.[7] ..... C25B 15/00

[52] U.S. Cl. ..... 204/515; 204/600

[58] Field of Search ..... 204/515, 600

[56] References Cited

U.S. PATENT DOCUMENTS 4,600,486 7/1986 Oppitz ..... 204/182.3
5,015,351 5/1991 Miller ..... 204/182.3
5,368,709 11/1994 Utklev ..... 204/515

FOREIGN PATENT DOCUMENTS 140265 2/1988 European Pat. Off. .
81067852 11/1981 Sweden .

*Primary Examiner*—Bruce F. Bell
*Assistant Examiner*—Thomas H Parsons
*Attorney, Agent, or Firm*—Ohlandt, Greeley. Ruggiero & Perle, L.L.P.

[57] ABSTRACT

In a method for regulating and optimizing transport of liquid in a porous structure by means of electroosmosis, a pulse pattern applied to one or more electrode pairs which are used during the electroosmosis is regulated by detecting a potential difference $\Delta V_p$ over the electrode pair or electrode pairs during the duration $t_3$ of a neutral pulse which forms part of the pulse pattern and subsequently regulating either the duration $t_3$ of the neutral pulse or the duration $T_p$ of the pulse pattern or both on the basis of the detected potential difference $\Delta V_p$ and any change therein from measuring cycle to measuring cycle. A device for implementing the method comprises a power source with a pulse generator which supplies the desired pulse patterns to one or more electrode pairs (A, K) with the anode (A) provided in the porous structure and the cathode (K) in earth respectively, a voltage detector connected in series via each electrode pair (A, K) and a program control unit in a loop between the voltage detector and the power source's pulse generator.

13 Claims, 1 Drawing Sheet

Figure 1:
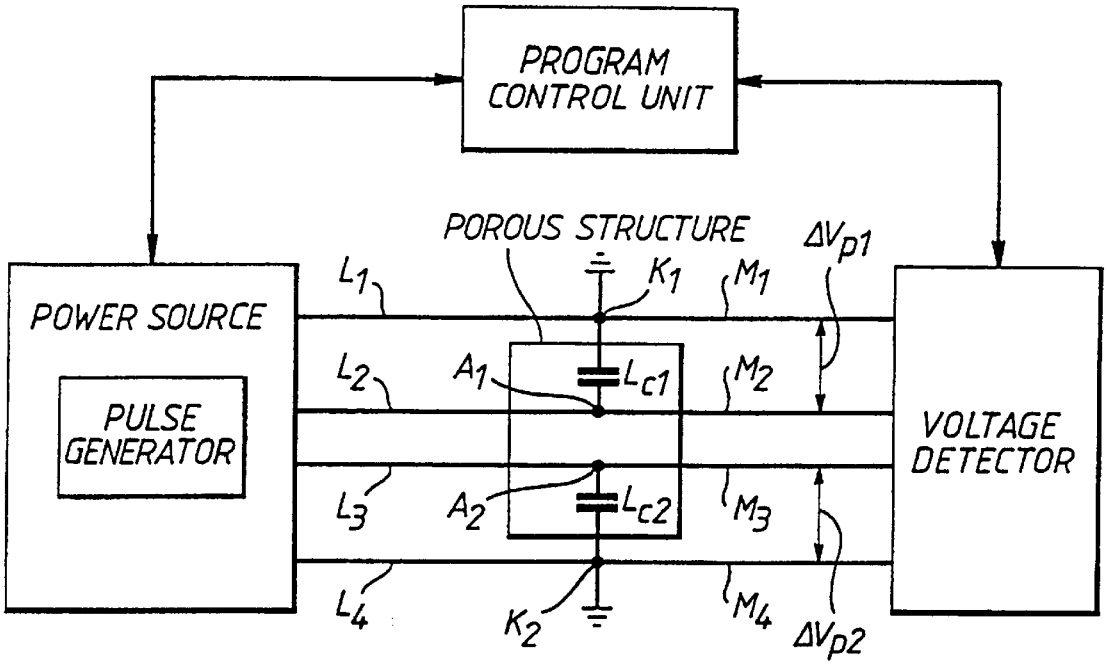

METHOD AND DEVICE FOR REGULATING AND OPTIMIZING TRANSPORT OF HUMIDITY BY MEANS OF ELECTROOSMOSIS

The present invention concerns a method for regulating and optimizing transport of liquid in porous structures by means of electroosmosis, wherein there are employed one or more electrode pairs, wherein each electrode pair constitutes an electrical circuit comprising an anode in the porous structure and a cathode in earth, where the anode and the cathode are connected to respective outputs on a power source which supplies a pulse voltage to the electrode pair in the form of a sequence of pulse patterns, and wherein each pulse pattern comprises a first positive pulse with a given amplitude $V_s$ and a duration $t_1$, a negative pulse with the same amplitude $V_s$, but substantially shorter duration $t_2$ than the positive pulse, and subsequently a neutral pulse whose duration $t_3$ is initially much less that the duration of the negative pulse and constitutes only a small fraction of the pulse pattern's $T_p$. The invention also concerns a device for implementing the method.

In Swedish patent publication No. 450 264 a method is disclosed for the removal of humidity in a brick wall by means of electroosmosis. An alternating voltage with a positive mean value is fed to electrodes in a concrete or masonry structure and to an earth electrode. The positive pulse is 2–20 times longer than the negative pulse, which must be at least 20 ms. According to this publication, similar method is also employed for introducing a hydrophobic liquid into the structure, again by means of an alternating voltage of the same type as that used in the removal of humidity, but now a positive pulse of 1 s and a negative pulse of 200 ms are used, while between the negative pulse and the subsequent positive pulse a neutral interval of 200 ms is employed.

When using electroosmosis for transport of liquids in porous media, especially for the expulsion of humidity from masonry, there is a problem that the process comes to a stop due to the build-up of a potential on the electrodes. In order to maintain the process until the relative humidity in the structure has dropped to a level where electroosmotic transport processes will no longer occur, the electrodes therefore have to be depolarized. According to the above-mentioned Swedish patent publication this takes place during the negative pulse.

It has been shown, however, that it is not possible to reduce the relative humidity by this means to a level where ionic transport phenomena entirely cease, which is one of the main objects of the removal of humidity by means of electroosmosis.

In U.S. Pat. No. 5,368,709 a method is disclosed for removing or controlling humidity in concrete or masonry structures by means of electroosmosis, where a pulse voltage is employed with a pulse pattern consisting of a positive pulse followed by a negative pulse of substantially shorter duration than the positive pulse and subsequently a neutral pulse whose duration can initially be much shorter than, e.g., the duration of the negative pulse. By increasing the duration of the neutral pulse in the course of the process and possibly also the duration of the pulse pattern, it will be possible to achieve an approximately complete depolarization of the electrodes, with the result that the electroosmotic process is maintained until the relative humidity in the structure has dropped to a level where the ionic transport phenomena in the liquid and thereby the electroosmosis entirely cease. The electrodes are then fed with a pulse voltage, where the pulse pattern has a form and duration which substantially correspond to those it had when the electroosmotic process stopped.

With this method, however, there is a problem that the pulse pattern and the adjustment thereof are performed without direct reference to the actual polarization state of the electrodes and mainly on an empirical or heuristic basis, with the result that the electroosmotic process is not optimal, even though the final result will generally be good.

Thus it is an object of the present invention to provide a method which permits regulation and optimization of transport of liquids in porous structures by means of electroosmosis in general and not only by expelling humidity from, e.g., concrete or masonry structures. It is conceivable that this object could be achieved by measuring the relative humidity in the porous structure directly and calculating changes in the relative humidity from one measuring cycle to another, and the rate of the change in the relative humidity could be used to regulate the duration of the neutral pulse and/or the duration of the pulse pattern. However, this is an expensive solution, which would require separate equipment for measuring the relative humidity in addition to a costly installation of this equipment in the porous structure, which would also entail a physical intrusion into the porous structure.

A second object of the invention is therefore to simplify the measuring apparatus and permit the determination of a rational control criterion for the regulation without the use of an expensive, comprehensive apparatus and without the necessity of a physical intrusion into the porous structure.

Figure 2:
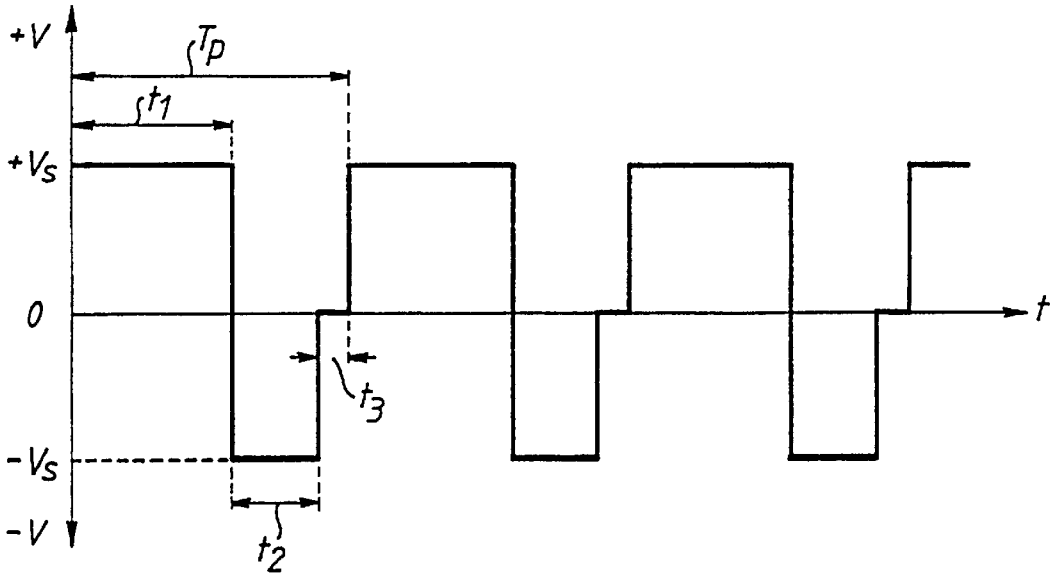

The invention will now be described in more detail with reference to the accompanying drawings, in which FIG. 1 illustrates a device for the transport of liquid in porous structures by means of electroosmosis, and FIG. 2 illustrates the pulse voltage employed in the electroosmosis in the form of a sequence of the pulse pattern.

FIG. 1 illustrates a device where there are employed in the porous structure two electrode pairs $A_1$, $K_1$; $A_2$, $K_2$, where $A_1$, $A_2$ indicate the anodes which are provided in the porous structure and $K_1$, $K_2$ the cathodes which are provided in earth. The electrode pairs are connected with respective outputs to a power source via the lines $L_1$, $L_2$; $L_3$, $L_4$ respectively, and the power source comprises a pulse generator for generation of the desired pulse pattern. Furthermore, each of the electrode pairs are connected to a voltage detector via respective measuring lines $M_1$, $M_2$; $M_3$, $M_4$. In a loop between the voltage detector and the power source there is provided a program control unit. Via the pulse generator on the lines $L_1$, $L_2$; $L_3$, $L_4$ the power source supplies to the respective electrode pairs $A_1$, $K_1$; $A_2$, $K_2$ a pulse voltage consisting of a sequence of pulse patterns composed of a positive pulse with duration $t_1$, and voltage amplitude $+V_s$, followed by a negative pulse with duration $t_2$ and a voltage amplitude $-V_5$ and then a neutral pulse with duration $t_3$, where $t_2$ is substantially less than $t_1$, with the result that the pulse pattern receives a positive voltage integral. Initially, i.e. at the start-up of the electroosmotic osmotic process, $t_3$ constitutes only a fraction of, e.g., $t_2$ and can advantageously be between 10 and 20 ms.

The voltage detector is now activated via the program control unit in a predetermined measuring cycle which is commensurable with the duration $T_p$ of a pulse pattern and which, when the neutral interval $t_3$ occurs, triggers the voltage detector to measure any potential difference between the electrodes A, K in each electrode pair on the measuring lines $M_1$, $M_2$ and $M_3$, $M_4$ respectively. Since no working voltage $\pm V_s$ is applied from the power source via the electrodes A, K, during this interval the voltage detector will detect the electrodes' possible polarization state as a potential difference $\Delta V_p$, with, for example, $\Delta V_{p1}$ the potential difference over the first electrode pair $A_1$, $K_1$ and $\Delta V_{p2}$ the potential difference over the second electrode pair $A_2$, $K_2$.

On the basis of the detected potential difference $\Delta V_p$ and a possible change in the detected potential difference $\Delta V_p$ the program control unit now gives a control value to the power source's pulse generator which causes the duration $t_3$ of the neutral interval to be changed and possibly also the duration of the pulse pattern $T_p$. This can be performed on the basis of the ratio $$\frac{\Delta V_p}{\Delta V_s}$$

with the result that t and/or $T_p$ are increased if an increase is detected in $\Delta V_p$. Similarly $t_3$ and/or $T_p$ are kept constant if $\Delta V_p$ is constant between each measurement or decreases.

Initially the duration $T_p$ of the pulse pattern can be pre-programmed to lie in the interval 1–4 s. and depending on the measured potential difference $V_p$ is regulated in such a manner that $T_p$ becomes up to 20 s. As mentioned, initially the duration $t_3$ of the neutral pulse can be very short, 10–20 ms, which is more than sufficient to perform the detection of the potential difference $\Delta V_p$. By regulating $t_3$ in such a manner that it is increased by a detected potential difference $\Delta V_p$ and in relation to the ratio $$\frac{\Delta V_p}{\Delta V_s},$$

an approximate optimal depolarization of the electrodes is achieved, since $\Delta V_p$ will be reduced during the duration $t_3$ of the neutral pulse. Thus by regulating the duration of the neutral pulse $t_3$ an approximately complete depolarization of the electrodes can be achieved, with the result that the detected potential difference $\Delta V_p$ will at all times constitute at the most an insignificant fraction of the working voltage $V_3$. The object is thereby achieved that the electroosmotic process becomes more efficient, since the polarization of the electrodes will otherwise reduce the efficiency of the process and could thereby cause it to come to a complete stop.

In the course of the process the regulation will ensure that both $t_3$ and $T_p$ increase until the ionic transport phenomena in the liquid which has to be transported cease since the relative humidity in the porous structure drops below a given level, for example 75–70% relative humidity. The program control unit will then put the power source in a maintenance phase, wherein a very low-strength current and a pulse voltage are supplied to the electrodes while the duration of the pulse pattern can be approximately 5 times the initial duration $T_p$ of the pulse pattern, in other words it will come to 5–20 s. Similarly the duration $t_3$ of the neutral pulse in this maintenance phase will be in the interval 1–8 s.

If the method according to the invention is employed, e.g., for drying masonry, the maintenance phase can be permanent and in this case a measuring cycle will be used for control of the electrodes' polarization state at very long intervals, e.g. from day to day or at intervals of several days.

When two electrode pairs have been provided, the program control unit can control the measuring cycles, the detection thus being performed in synchronous pulse patterns, but time-displaced in the interval $t_3$. By having the measurement of the potential difference $\Delta V_p$ performed in time multiplex, only one detector is required, since the same detector is switched via the program control unit in time multiplex from electrode pair to electrode pair. Alternatively, the program control unit can switch the voltage detector to the first electrode pair $A_1$, $K_1$ in a first measuring cycle and subsequently the voltage detector to the second electrode pair $A_2$, $K_2$ in a subsequent measuring cycle, with the result that the voltage detector detects the potential differences $\Delta V_{p1}$; $\Delta V_{p2}$ in different measuring cycles, possibly following immediately one after the other.

At the same time, the measuring cycle will be adjusted depending on the regulation of the pulse pattern via the pulse generator in the power source. The measuring cycle and the control power which cause the changes in the pulse pattern therefore form part of a control loop formed in the program control unit.

Even though the present invention is primarily described with a view to the use of electroosmosis for expelling humidity from porous structures, it should be understood that the method and device can be applied in the case of any porous structure where it is possible to cause electroosmotic processes, i.e. porous structures with capillaries. These are not limited to concrete and different kinds of masonry, but can include species of rock, minerals, earths and a great number of artificial materials. In this context, however, it is important to note that between the anode and the cathode in an electrode pair there is a capacitive load during electroosmosis. This is also indicated in FIG. 1, where the load between each electrode pair $A_1$, $K_1$; $A_2$, $K_2$ is indicated in each case as a capacitive load or $L_{c1}$ or $L_{c2}$.

I claim:

1. A method for regulating and optimizing transport of liquid in a porous structure by means of electroosmosis, wherein there are employed one or more electrode pairs, wherein each electrode pair constitutes an electrical circuit comprising an anode in the porous structure and a cathode in earth, wherein the anode and the cathode are connected to respective outputs on a power source which supplies a pulse voltage to the electrode pair in the form of a sequence of pulse patterns, and wherein each pulse pattern comprises a first positive pulse with a given amplitude $V_s$ and a duration $t_2$, a negative pulse with the same amplitude $V_5$, but substantially shorter duration $t_1$ than the positive pulse, and subsequently a neutral pulse whose duration $t_3$ is initially much less than the duration of the negative pulse and constitutes only a small fraction of the pulse pattern's duration $T_p$, characterized by detecting any potential difference $\Delta V_p$ over the anode and the cathode in at least one electrode pair during the duration $t_3$ of the neutral pulse in the pulse pattern which falls in the first measuring cycle, and, if $$\Delta V_p = 0,$$

depending on the ratio $$\frac{\Delta V_p}{\Delta V_s},$$

regulating a) the duration $t_3$ of the neutral pulse, or b) the duration of pulse $T_p$ of the pulse pattern, or c) both the duration $t_3$ of the neutral pulse and the duration $T_p$ of the pulse pattern, whereupon the measuring cycle is repeated with a predetermined repetition frequency, since the duration $t_3$ of the neutral pulse or the duration $T_p$ of the pulse pattern or both increase if the detected potential difference $\Delta V_p$ increases from one measuring cycle to another, and is otherwise kept constant, with the result that the duration $t_3$ of the neutral pulse at a maximum will amount to approximately twice the initial duration $t_2$ of the negative pulse, and the duration $T_p$ of the pulse pattern at the most 5–10 times the initial duration $T_p$ of the pulse pattern, whereupon these final values for the duration $t_3$ of the neutral pulse and the duration $T_p$ of the pulse pattern are used in a maintenance phase after the liquid transport has ceased.

2. A method according to claim 1,
characterized in that the duration $t_2$ of the negative pulse amounts to between 0.1 and 0.2 times the duration $t_1$ of the positive pulse.

3. A method according to claim 1,
characterized in that the duration $t_3$ of the neutral pulse initially lies between 10 ms and 20 ms.

4. A method according to claim 1,
characterized in that the duration $T_p$ of the pulse pattern is regulated in the interval 1–20 s.

5. A method according to claim 1,
characterized in that the duration $T_p$ of the pulse pattern is selected initially in the interval 1–4 s.

6. A method according to claim 1,
characterized in that the duration $T_p$ of the pulse pattern in the maintenance phase is regulated in the interval 5–20 s.

7. A method according to claim 1,
characterized in that the duration of the neutral pulse in the maintenance phase is regulated in the interval 1–8 s.

8. A method according to claim 1,
characterized in that the measuring cycle's repetition rate is preselected to lie in a frequency range from the initial pulse pattern frequency to once every 24 hours.

9. A method according to claim 1 or 8, wherein more than one electrode pair is used,
characterized in that the pulse pattern for each electrode pair is regulated by detecting the potential difference $\Delta V_p$ for each electrode pair in one and the same measuring cycle by means of time-multiplexed detection.

10. A method according to claim 1 or 8, wherein more than one electrode pair is used,
characterized in that the pulse pattern for each electrode pair is regulated by detecting the potential difference $\Delta V_p$ in the neutral interval for each electrode pair in different measuring cycles.

11. A method according to claim 1,
characterized in that it is implemented via a program control unit connected to a voltage detector and the power source respectively.

12. A method according to claim 1,
characterized in that the measuring cycle is adjusted depending on the effected change in the pulse pattern via a control loop provided in the program control unit.

13. A device for implementing the method for regulating and optimizing transport of liquid in a porous structure by means of electroosmosis, wherein there are employed one or more electrode pairs, wherein each electrode pair constitutes an electrical circuit comprising an anode in the porous structure and a cathode in earth, wherein the anode and the cathode are connected to respective outputs on a power source which supplies a pulse voltage to the electrode pair in the form of a sequence of pulse patterns, and wherein each pulse pattern comprises a first positive pulse with a given amplitude $V_5$ and a duration $t_1$ a negative pulse with the same amplitude $V_5$, but substantially shorter duration $t_2$ than the positive pulse, and subsequently a neutral pulse whose duration $t_3$ is initially much less than the duration of the negative pulse and constitutes only a small fraction of the pulse pattern's duration $T_p$, characterized in that one or more electrode pairs (A, K) are connected respectively in series via a voltage detector, that the voltage detector is connected to a program control unit, and that the program control unit is connected to a pulse generator provided in a power source, such that on the basis of a potential difference $\Delta V_p$ over each electrode pair (A, K) and detected during the duration $t_3$ of the neutral pulse in a pulse pattern generated by the pulse generator, the program control unit regulates the pulse pattern supplied from the power source to the electrode pair or electrode pairs with regard to the duration $t_3$ of the neutral pulse or the duration $T_p$ of the pulse pattern or both.

* * * * *

UNITED STATES PATENT AND TRADEMARK OFFICE

CERTIFICATE OF CORRECTION

PATENT NO. : 6,126,802
DATED : October 3, 2000
INVENTOR(S) : Kjell Utklev

It is certified that error appears in the above-identified patent and that said Letters Patent is hereby corrected as shown below:

Column 3,
Lines 14-16, "$\frac{\Delta V_p}{\Delta V_s}$" is to be deleted and -- $\frac{\Delta V_p}{V_s}$ -- is to be inserted.

Lines 31-33, "$\frac{\Delta V_p}{\Delta V_s}$" is to be deleted and -- $\frac{\Delta V_p}{V_s}$ -- is to be inserted.

Line 42, "$V_3$" is to deleted and -- $V_s$ -- is to be inserted.

Column 4,
Lines 57-59, "$\frac{\Delta V_p}{\Delta V_s}$" is to be deleted and -- $\frac{\Delta V_p}{V_s}$ - - is to be inserted.

Line 52, "$\Delta V_p = 0$" is to be deleted and -- $\Delta V_p \neq 0$ -- is to be inserted.

Signed and Sealed this

Nineteenth Day of August, 2003

JAMES E. ROGAN
*Director of the United States Patent and Trademark Office*